US009524712B2

(12) United States Patent
Vaidhyanathan et al.

(10) Patent No.: US 9,524,712 B2
(45) Date of Patent: Dec. 20, 2016

(54) ADAPTIVE FILTERING FOR WIRED SPEAKER AMPLIFIERS

(71) Applicant: INTEL CORPORATION, Santa Clara, CA (US)

(72) Inventors: Ajay Kumar Vaidhyanathan, Banglaroe (IN); Ramaswamy Partha Parthasarathy, Bangalore (IN); Sudarshan D. Solanki, Bangalore (IN); Bala P. Subramanya, Bangalore (IN); Yagnesh V. Waghela, Bangalore (IN); Vikas Mishra, Bangalore (IN); Devon Worrell, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/841,382

(22) Filed: Aug. 31, 2015

(65) Prior Publication Data

US 2016/0232886 A1 Aug. 11, 2016

(51) Int. Cl.
*G10K 11/178* (2006.01)

(52) U.S. Cl.
CPC ..... *G10K 11/178* (2013.01); *G10K 2210/1081* (2013.01); *G10K 2210/3026* (2013.01); *G10K 2210/3028* (2013.01)

(58) Field of Classification Search
None
See application file for complete search history.

(56) References Cited

U.S. PATENT DOCUMENTS

| | | | | |
|---|---|---|---|---|
| 5,557,653 | A * | 9/1996 | Paterson | H04M 1/6058 455/575.2 |
| 7,444,174 | B2 * | 10/2008 | Zhu | H04B 1/3833 439/76.1 |
| 8,369,252 | B2 * | 2/2013 | Walley | H04B 15/00 370/280 |
| 2003/0202664 | A1 * | 10/2003 | Brodkin | H04R 5/04 381/1 |

* cited by examiner

*Primary Examiner* — Paul Huber
(74) *Attorney, Agent, or Firm* — Blakely, Sokoloff, Taylor & Zafman LLP

(57) ABSTRACT

Adaptive filtering is described for use with amplifiers for any wired speaker. In one example, an apparatus includes an audio cable to provide an analog audio signal to an audio transducer, such as a speaker, the audio cable also receiving a modulated noise current, an output amplifier to receive an audio input, to generate an audio output by amplifying the audio input, and to provide the audio input to the audio cable, and a feedback system to receive the audio output and to receive a reference signal and to generate a noise cancellation signal to the output amplifier, the noise cancellation signal to cancel the modulated noise current.

19 Claims, 6 Drawing Sheets

ADAPTIVE FILTERING FOR WIRED SPEAKER AMPLIFIERS

CROSS-REFERENCE TO RELATED APPLICATIONS

The present application claims priority of prior-filed Indian patent application serial No. 4280/CHE/2014 filed Sep. 3, 2014, entitled ADAPTIVE FILTERING FOR WIRED SPEAKER AMPLIFIERS, by Ajay Kumar Vaidhyanathan al. and assigned to the assignee of the present application, the priority of which is hereby claimed.

FIELD

The present disclosure relates to audio systems for headsets and other wired speakers and, in particular, to adaptive filtering for noise received by wires and coupled into a speaker amplifier

BACKGROUND

With the increased sale and use of personal media players and now portable smart phones, headphone use continues to increase. Internet radio stations and streaming music and video services provide content at all hours. Users enjoy music, video, and telephone conversations through wired earphones, earbuds, and headphones. Because these devices are portable they, and their corresponding wired headsets are used more often and in many different environments. With a large investment in headsets users are also more prone to use them also with tablets, notebook computers, and many other portable and even fixed devices.

A stereo headphone set, coupled into a mains-powered headphone amplifier in the living room still provides a clear clean audio experience to a careful listener. A lightweight mobile headset coupled to a portable device, on the other hand, may turn out to be unpleasant or even dangerous. The wires of a wired headset not only carry electrical analog power signals to the connected speakers but also act as wire antennas to receive ambient electro-magnetic noise in the environment surrounding the user. The electro-magnetic energy in the ambient is converted to electricity by the headset wires and propagates in both directions within the headset wires. Different headsets couple different amounts and types of noise based on their antenna properties. Their antenna properties comes from their geometry, material properties etc. In other words, the RF (radio frequency) noise coupled into the system causes an RF current in the wires.

The RF noise will travel toward the audio transducers at the user's ears and be coupled into those transducers. The signal level is typically so low that this noise is inaudible. The RF noise will also be coupled into the audio amplifier that is driving audio signals to the audio transducers. In this case, the RF noise is amplified and may even develop a feedback loop. The amplified noise may be annoying to the user and may possibly be loud enough to be a safety risk for the user. While RF noise is typically at frequencies, e.g. 150 kHz to 6 GHz, beyond the range of human hearing, e.g. 20 Hz to 20 kHz, the RF signal in the headset wires can carry a modulating signal that is within the human hearing range. A non-linear audio amplifier typically demodulates the modulated RF noise signal. In so doing it generates a low frequency audio noise signal that is then amplified and provides noise in the headset.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

By using an adaptive feedback mechanism to cancel out the noise received by headset wires, a wide range of different noise sources and types can be filtered out. In addition many different types of headsets can be accommodated. In one embodiment, the adaptive feedback system compares the amplifier output to a golden standard (such as the amplifier input) and corrects for any unwanted noise.

Such an adaptive noise cancellation circuit may be integrated into an SOC (System on a Chip) or into a CODEC (Coder/Decoder). Such a large scale digital integrated circuit implementation allows the cancellation circuit to be made to be very small and to operate very fast. The circuit may also be programmed to adapt to a broad range of headsets and noise frequencies.

The amplified noise can also be avoided by adding better shielding to the headset wires. However, this makes the wires more expensive, thicker, and heavier. Many users prefer low cost, thin, lightweight wires. The amplified noise can also be avoided using passive filters in the audio circuit. For this reason many smartphones include a passive single stage or multistage filter circuit between the audio amplifier and the headset connector jack. This circuit filters out RF noise signals in the audio band after the noise signals are amplified but before they reach the headset wire. The passive filters can be tuned specifically for operation with a particular smartphone design, headset, and noise environment.

The passive filters cannot be scaled for different headsets. The amount of noise coupled by a given headset depends on internal geometry, shielding, material etc. Even for the same headset, the coupled noise curves change even with production variations. In addition, when filtering out the input noise, the frequency range may be from 150 kHz to 6 MHz. A flat pass-band discrete filter is difficult to design for such a broad range.

Figure 1:
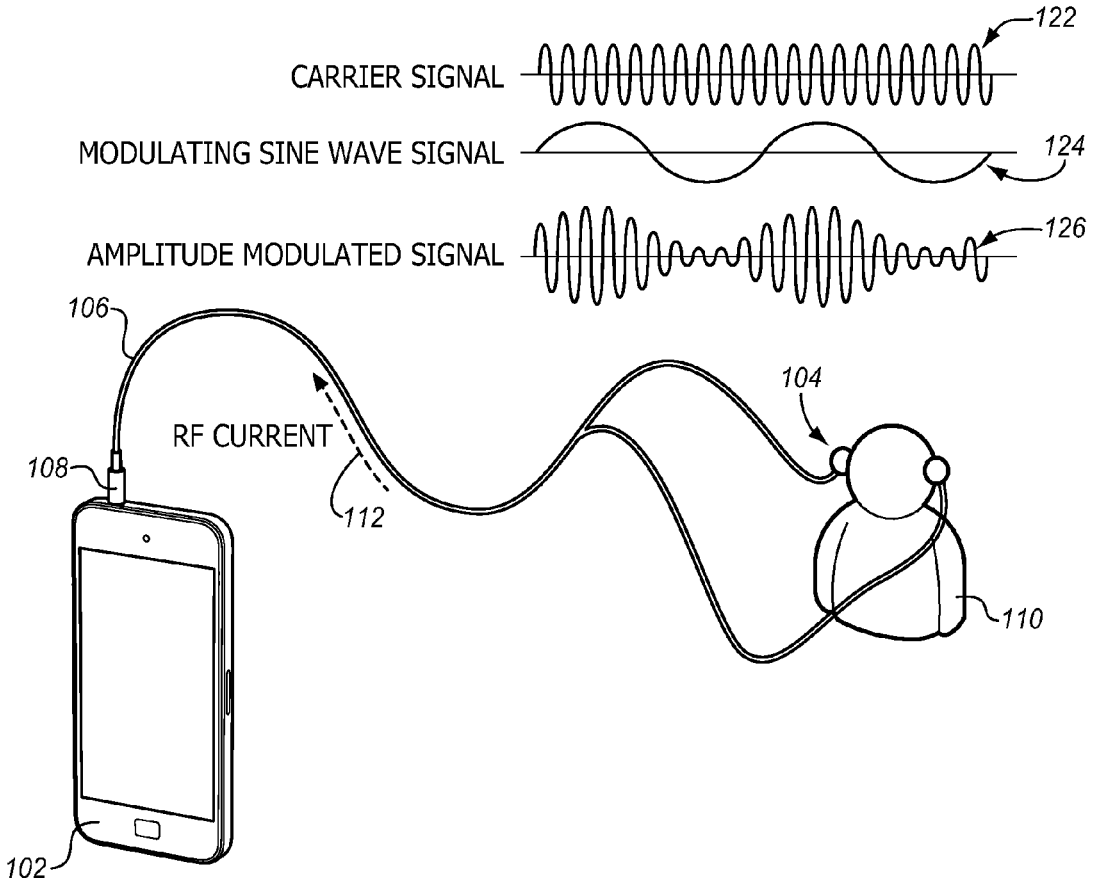
FIG. 1 is a diagram of an audio player with a headset in an ambient environment showing noise as a modulated current in the headset wires.

FIG. 1 is a diagram showing the flow of noise current in the wires of a headset. A smartphone or personal media player 102 has a connected headset 104. The headset is connected through a wire 106 or analog audio cable to a connector 108 on the smartphone 102. The headset wire connects through a conventional miniature or micro phono plug or may connect through any other type of connection.

As shown, the personal media player streams some sort of audio signal to a user 110 through the headset wires 106 to be played back to the user.

If there is radio frequency noise 126 in the ambient environment, then this may be received by the headset wires 106 as an RF current ($I_{RF}$) which act for some purposes like a receiving antenna. After being coupled into the headset wires, this ambient noise travels as an RF current indicated by arrow 112 through the headset wires into the media player or phone. The ambient noise is in the form of RF electromagnetic waves 122. These waves may have frequencies from about 150 kHz to 6 GHz. The waves are modulated by an AM signal 124 also in the ambient. The resulting noise signal 126 has a modulation and the high frequency carrier wave.

When the modulation is within an audible frequency, the noise signal 112 may be de-modulated from its carrier, amplified by the phone and played back to the user 110. This can cause a disturbing unpleasant loud or even dangerous noise in the user's headset or another audio transducer, such as a speaker driver. While a wired headset is shown, any other type of wired audio playback device may experience the same effect through the wires that connect the audio playback device or transducer to the amplifier. This may include fixed or portable small speakers, a variety of different kinds of headphones and hands-free speaker microphone systems.

The analog audio cables 106 will be referred to generally as headset wires as shown here. However, any analog audio cable may be subject to ambient noise and be able to carry a noise current back to a media player 102. The audio cable 106 may provide audio to one or more drivers of a headset or to any other audio transducer that may or may not be suitable for wearing on the head. The headset may produce monaural or stereo music and may include a microphone and associated cable, and a control interface and associated cable. The techniques described herein may be applied to many different wired audio systems including smartphone in-ear headphones with a remote and microphone as well as to a two-way radio single ear headset with microphone.

Figure 2:
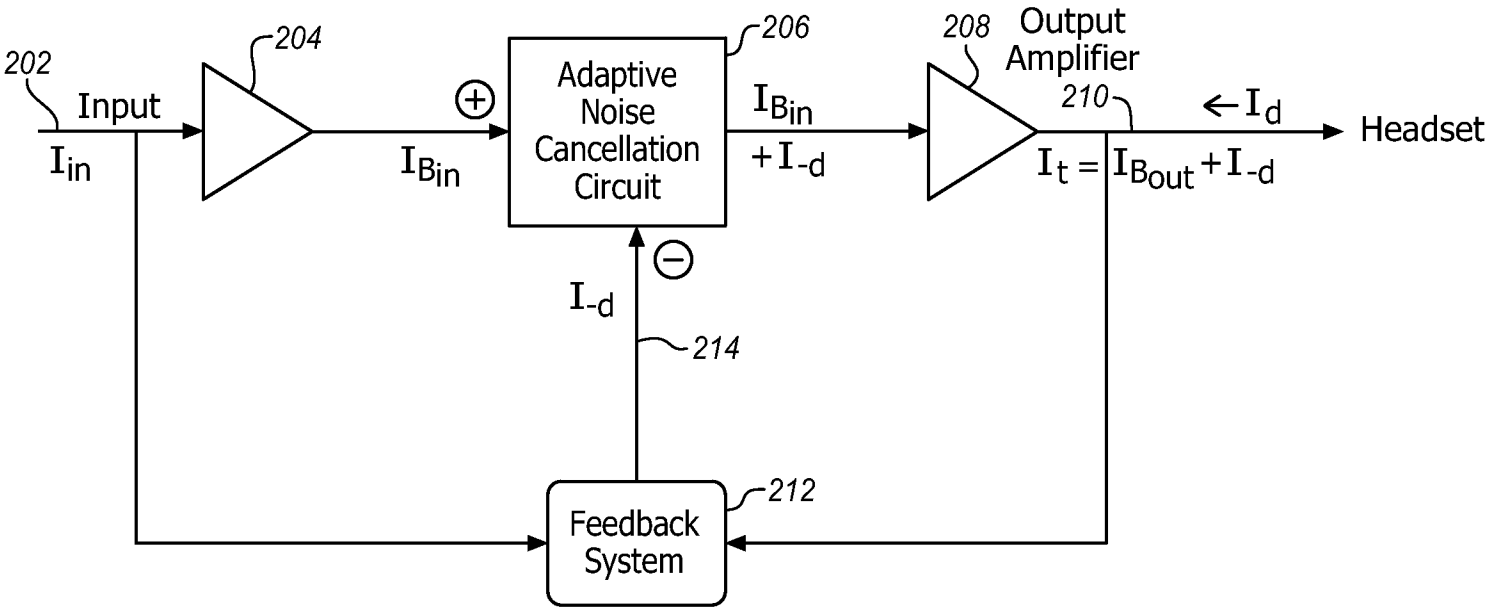
FIG. 2 is a generalized block diagram of an adaptive noise cancellation system according to an embodiment.

FIG. 2 is a general diagram of an environment for an adaptive noise cancellation circuit. An audio input $I_{in}$ 202 from a preamplifier is fed to a power amplifier 204. The audio input may be voice, music, video soundtrack, or any other type of audio. The power amplifier may be an op amp (operational amplifier) or any other type of amplifier. It may operate as Class A, B, A/B, D, T, or as any other type. The amplified audio $I_{Bin}$ is applied to an adaptive noise cancellation circuit 206. Noise from the headset wires is cancelled at this circuit. The noise cancelled audio is then fed to a buffer amplifier or output amplifier 208 as the output electrical audio signal 210. The amplified output signal $I_t$ is then coupled to the headset. Typically a small jack is provided to receive and connect to the headset plug, however, the headset may be provided in any other way depending on the particular implementation.

The original input 202 from the preamplifier is also applied to a feedback system 212. This signal serves as a reference for a true or golden standard audio signal before amplification and before noise is injected from the headset wire. In addition, the headset wire is coupled through the audio output 210 to the feedback system. In this case, the output serves as a noise input from the headset wires into the feedback system. The feedback system has a tap on the audio output to receive any signal on that line. The feedback system compares the signal at the audio output 210 to the signal at the audio input 202 and generates a noise cancellation signal 214 based on the comparison. The cancellation signal is added to the power amplifier 204 output signal to cancel the noise that will be introduced through the headset wires.

All of the elements shown in FIG. 2, including a complete adaptive noise cancellation filter may be integrated inside a silicon codec chip. The elements couple to audio sources on the input side and audio sinks on the output side. In between the source and the sink there may also be additional components for isolation, impedance matching, volume limits, and many other functions.

The adaptive noise cancellation circuit 212 inside the silicon cancels noise on the feedback loop using components of an integrated DSP (Digital Signal Processor). The noise cancellation circuit may operate using a differential cancellation of low frequency modulating noise between the input and the output of the audio amplifier.

As mentioned above, the noise received by the headset wires is typically in the form of an RF current or noise current. When this current is demodulated by the buffer amplifier 208, the output of the buffer amplifier will be the sum of the buffer amplifier's input signal from the power amplifier $I_{Bin}$ and the demodulated RF noise signal $I_d$. This may be expressed as $I_t$=BG*($I_{Bin}$+$I_d$), where $I_t$ is the total output current of the buffer amplifier, BG is the gain of the buffer amplifier $I_{Bin}$ is the input to the buffer amplifier from the power amplifier and $I_d$ is the current from the demodulated amplified RF noise.

The feedback system 212 receives both $I_t$ from the buffer amplifier and $I_{in}$ from the power amplifier input. This allows it to determine the other value $I_d$. $I_t$ is normally equal to $I_{in}$*TG, where TG is the total gain from the both the power amplifier and the buffer amplifier. When demodulation occurs $I_d$ will be added to this.

The feedback system compares $I_t$ and $I_{in}$. Based on the observed error, that is the difference between the input and the output, the feedback system generates an error correction signal to cancel the noise seen at the output. The error correction signal may take many forms but is typically an out of phase signal $I_{-d}$ to the noise signal observed in the output. The correction signal is combined with the noise signal to cancel the noise and return the buffer amplifier output to normal amplitude. Since only the output noise signal is cancelled, the normal output signal will remain the same without any attenuation.

The noise feedback loop components may be selected to ensure the loop stability within the dynamic range of the demodulated signal. Any demodulation that occurs at the output buffer amplifier 208, which is the output stage of the filter, will be observed by the tap to the feedback system 212. Any electromagnetic interference (EMI) or system noise will cause an RF current to flow from the headset cable into the connection to the feedback system. This RF current will have an AM modulated carrier. If the AM signal is demodulated from the carrier, then the noise cancellation circuit on the feedback loop cancels it by generating an out of phase signal at the input of noise cancellation circuit 206. The closed loop noise cancellation circuit uses the pre-amp section of the audio stage as a reference to cancel every signal other than the reference. This includes any demodulation that happens around the loop including the front end of any filter as well as any amplifier outputs.

Figure 3:
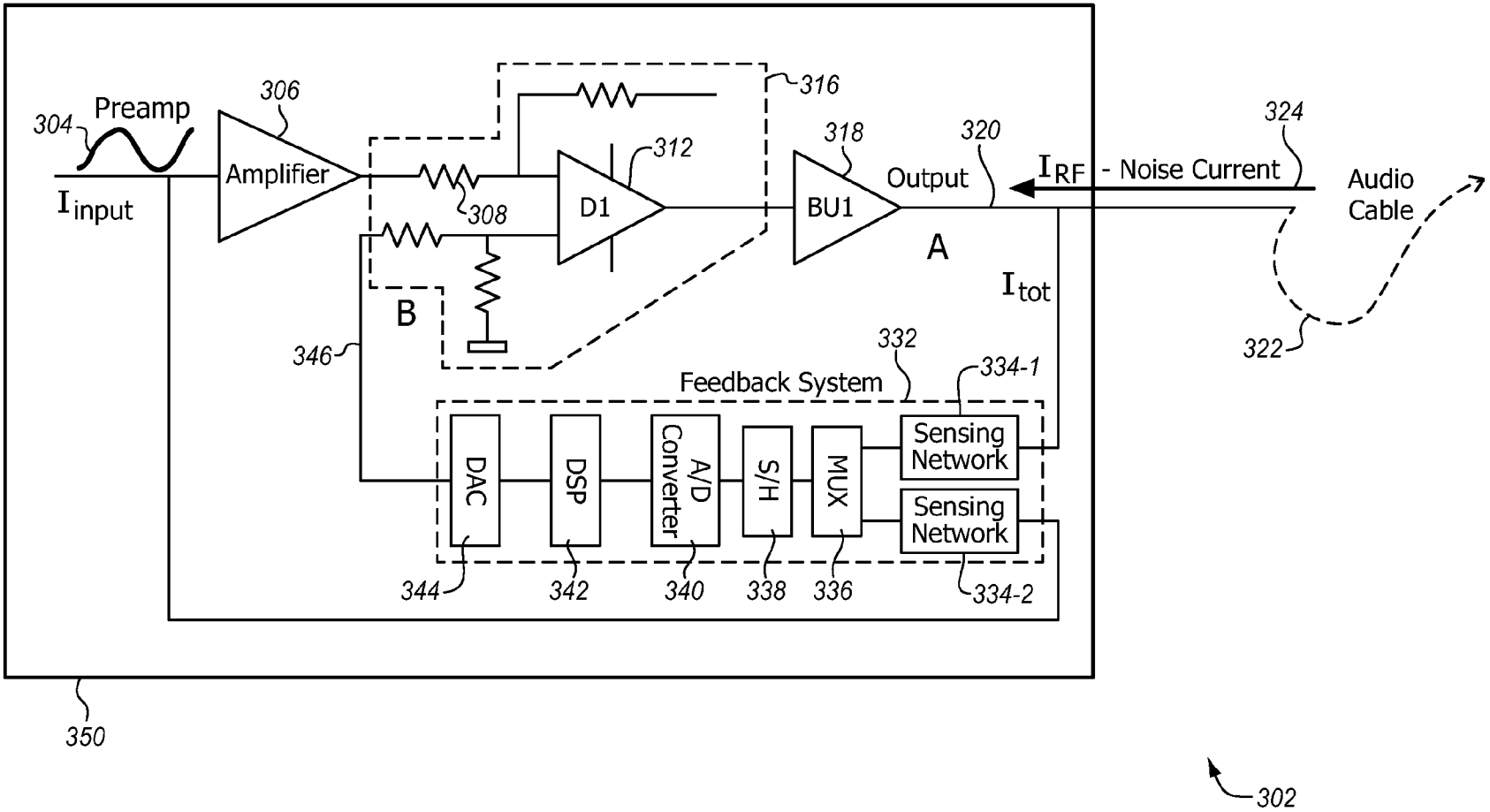
FIG. 3 is a block diagram of an example of an adaptive noise cancellation system according to an embodiment.

FIG. 3 is a diagram of an audio feedback and noise cancellation system 302 suitable for implementing the noise cancellation described above with respect to FIG. 2. An input current ($I_{in}$) 304 is supplied to a power amplifier 306. The power amplifier is fed through a load 308 to a differential amplifier 312. The differential amplifier is part of an adaptive noise cancellation circuit 316. From the differential amplifier the output signal is applied to a buffer amplifier 318 and the output signal ($I_t$) 320 is sent into an audio cable 322 to power a user headset, speaker or other audio device. The total current output from the buffer amplifier 318 is then mixed with a noise current ($I_d$) 324 that is received by the headset wire and fed back into the system.

The pre-amplifier input 304 and the buffer amplifier output 320 (at A) are supplied as inputs (at B) to a feedback system 332. Each input is supplied to a respective sensing network 334-1, 334-2 of the feedback system 332. The results from the sensing network are multiplexed in a multiplexer 336 and the combined signal is applied to a sample and hold circuit 338. The sample and hold (S/H) circuit stabilizes the output for a short period of time and this is then applied to an analog to digital converter (ADC) 340. The sample and hold helps the analog to digital converter to obtain stable consistent samples. The digitized version of the multiplexed signal is applied to a DSP (Digital Signal Processor) which compares the two input signals. The DSP is able to compare the reference input signal 304 to the actual output signal 320 which is combined with the noise current ($I_{RF}$) 324. The DSP can then generate a cancellation signal ($I_{-d}$) (at C) to eliminate the noise current from the output.

The DSP can also invert the phase of the generated signal so that the signal is a cancellation signal. In addition, the DSP is able to compensate for the delay between when the noise signal is sensed or detected from the tap at the output into the feedback system to the time that the feedback system output is applied into the noise cancellation circuit 316. Because the noise signals are on the order of kilohertz in the audible frequency range and the DSP can operate with a system clock in the gigahertz range, the DSP is able to generate a cancellation signal that is one-half phase or one-quarter cycle later than the noise current so as to cancel out the noise current even before a full cycle of the noise signal is completed. The predictive cancellation signal ($I_{-d}$) from the DSP 342 is applied to a digital analog converter (DAC) 344 to convert the signal to an analog form.

The analog noise cancellation signal 346 is then applied to the differential amplifier 312. Accordingly, the differential amplifier receives the power amplifier 306 output and the cancellation signal 346 both through loads 308 into the differential amplifier 312. These signals are combined and applied together to the buffer amplifier 318. As a result, the incoming noise current is cancelled by the cancellation signal that is amplified in the output from the buffer amplifier 318. This system is able to cancel the incoming noise signal ($I_{RF}$) as it occurs. This system is also able to adapt to changes to the incoming noise current that may occur with changing ambient environment or changing headsets. Because of the digital implementation of the feedback system 332, the entire signal amplification and noise cancellation system may be constructed on a single chip. This is shown in the figure as a single system on chip (SoC) block 350. Considering the different components shown with the SOC 350 the additional feedback system 332 and differential amplifier cancellation circuit 316 require very little additional space on the chip. This circuitry can easily be added to the same chip with the amplifiers 306, 318 and other filters and circuitry (not shown) that are typically included in an audio codec and amplifier system.

Figure 4:
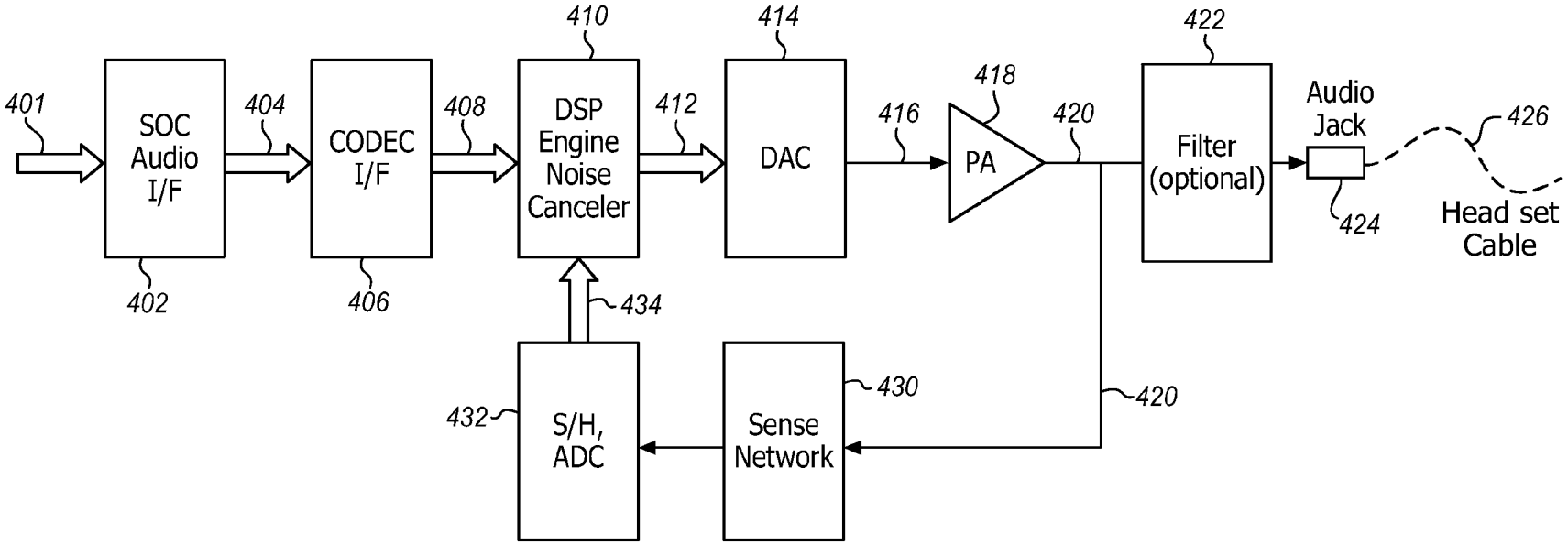
FIG. 4 is a block diagram of a second example of an adaptive noise cancellation system according to an embodiment.

FIG. 4 is a diagram of a second particular implementation of an adaptive noise cancellation circuit as shown in FIG. 2. In this alternative configuration, a system on a chip audio interface 402 receives an audio input signal 401 and generates an audio signal 404 which is applied to a codec interface 406. The codec output 408 is then applied to a noise canceller 410 in a DSP engine. The signal with the noise cancellation 412 is then applied to a DAC 414. The analog audio signal 416 is then applied to a power amplifier 418 and the amplified output 420 is filtered 422 as desired and coupled to an audio output jack 424. A headset cable 426 attaches to the audio jack when the headphones are in use.

As in the example of FIG. 3, the power amplifier output 420 together with any noise ($I_{RF}$) from the analog audio cable 426 is also applied to a sense network 430. The processed signal is then applied to a sample and hold (S/H) and analog to digital converter (ADC) 432. This feedback signal 434 is then plugged back into the noise canceller 410. The noise canceller, the sense network and S/H ADC as well as the codec can all be part of an audio DSP. The audio signal through the codec is not only the input but also the golden reference for the true audio output. The digitized feedback from the power amplifier through the ADC 432 can be compared to the reference signal within the digital noise canceller 410. This DSP engine can compute filter coefficients based on the golden reference and the feedback from the power amplifier. The DSP output then drives the audio amplifier and power amplifier stages.

Figure 5:
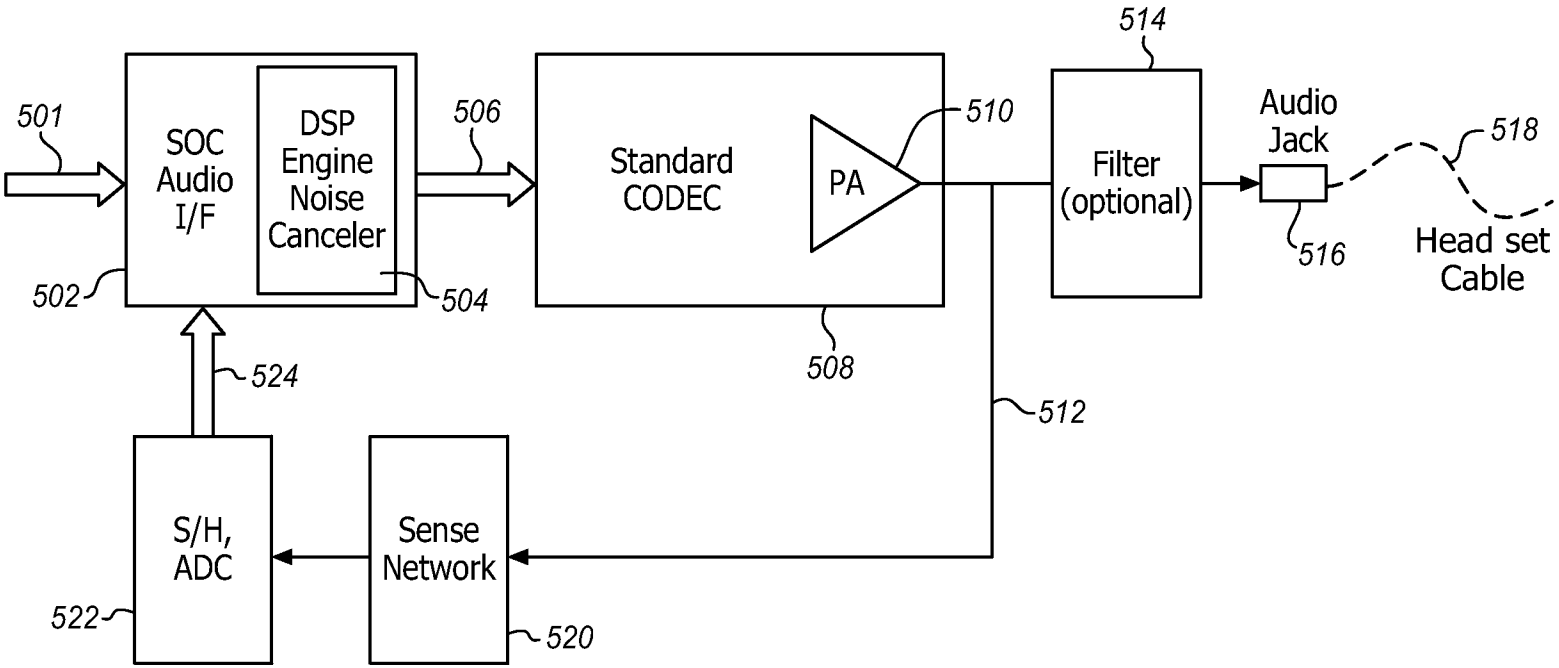
FIG. 5 is a block diagram of a third example of an adaptive noise cancellation system according to an embodiment.

FIG. 5 is a diagram of a third particular implementation of an adaptive noise cancellation circuit as shown in FIG. 2. In this further alternative a system on a chip integrates DSP functions and audio processing functions into a single system. The system has an audio interface 502 which receives the input audio 501 and performs the appropriate audio processing. The audio interface includes the DSP engine noise canceller 504 which operates on the audio signal and then sends the noise cancellation and input audio combined signal 506 to a codec 508 that includes a power amplifier 510. The amplifier output 512 is filtered 514 and applied to an audio jack 516. The audio jack couples to a headset cable 518 which, acting as an antenna, receives various noise signals as RF currents that are fed back through the filter to the power amplifier output into a sense network 520 of a feedback system.

As in the example of FIG. 4 the sense network and sample and hold operate in the analog domain but the output signal from the sample and hold is converted to a digital signal at a combined S/H ADC 522. This feedback signal 524 is fed back into the audio interface and DSP engine noise canceller 502 where a noise cancellation signal is generated. In this example, the SOC integrates DSP functionality and audio processing capability in one hardware chip. The SoC receives feedback from the audio power amplifier through the S/H ADC block. Blocks of the SOC perform the necessary cancellation calculations and update the audio files accordingly. The codec 508 connects to the SOC 502 through any desired standard interface, for example $I^2S$, and these standardized digital signals are applied to the codec to decode the digital signals into analog and amplify them in a single block 508.

The integrated adaptive noise filters described herein require no external filter design. The same filter may be used with any headset and the filter may be applied to the entire audible frequency range.

Figure 6:
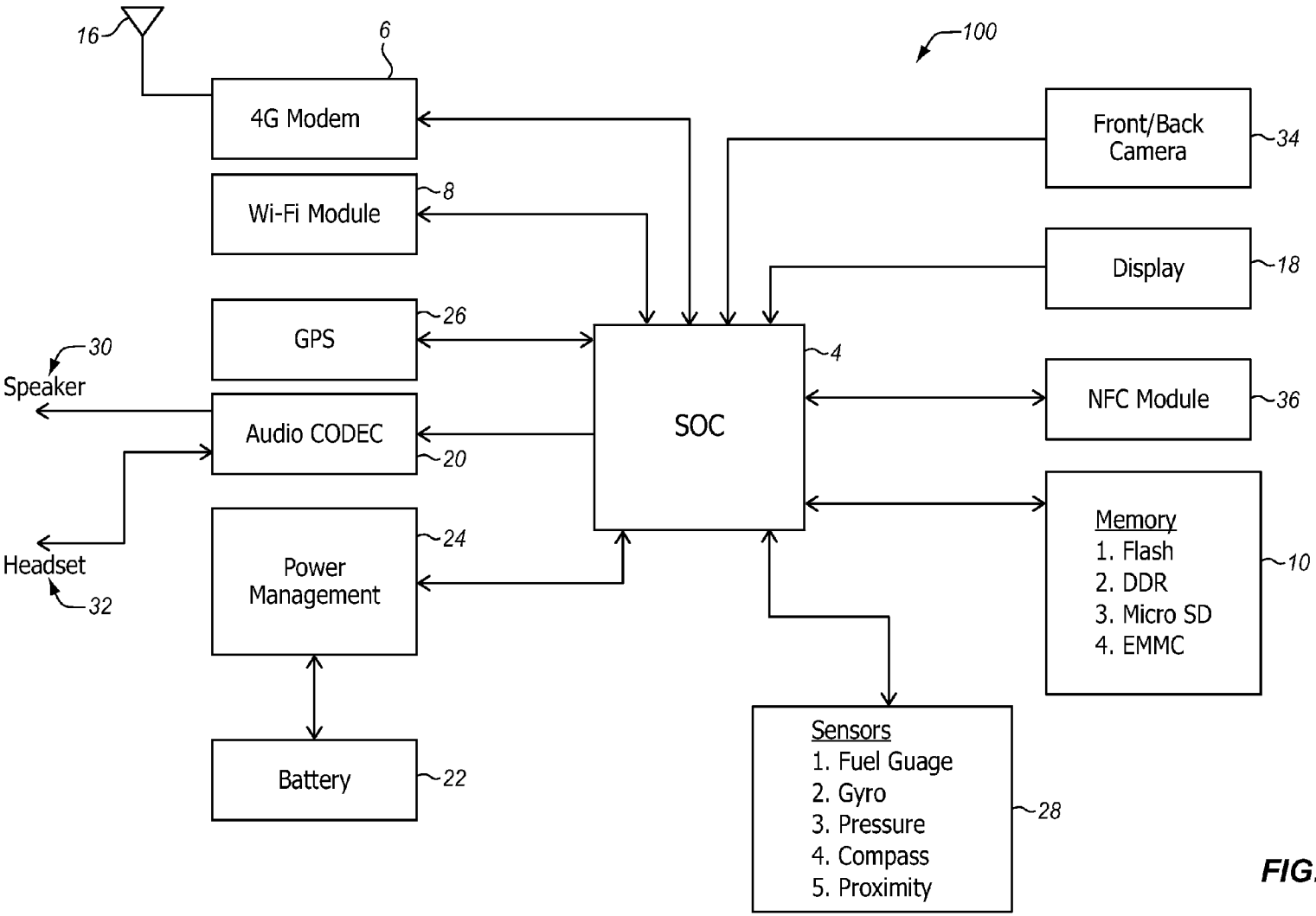
FIG. 6 is a block diagram of an audio player device incorporating noise cancellation according to an embodiment.

FIG. 6 illustrates an audio player device 100 in accordance with one implementation. The device 100 may include a number of components, including but not limited to a processor and at least one communication package 6. The communication package is coupled to one or more antennas 16. The processor, in this example is housed with an SoC (System on a Chip) 4 which is packaged. The package is physically and electrically coupled to a system board.

Depending on its applications, the SoC may include other components that may or may not be on the same chip or in the same package. These other components include, but are not limited to, volatile memory (e.g., DRAM), non-volatile memory (e.g., ROM), flash memory, a graphics processor, a digital signal processor, a crypto processor, and a chipset. The SoC is coupled to many other components that may be on the same or a different attached system board. These include the antenna 16, a display 18 such as a touchscreen display with a touchscreen controller, a battery 22 and associated power management system 24, an audio codec 20, a video codec (not shown), a power amplifier (not shown), a global positioning system (GPS) device 26, a sensor suite 28, which may include a compass, an accelerometer, a gyroscope, a proximity sensor, a pressure sensor, a battery fuel gauge etc. The SoC may also be connected to a speaker 30, a headset 32, a camera and microphone array 34, and a mass storage device (such as flash cards, hard disk drive, etc.) 10, an NFC (Near Field Communication) module 36, any of a variety of other peripheral devices, including players for optical disks and other external media (not shown).

The communication package enables wireless and/or wired communications for the transfer of data to and from the audio player device 100. Such systems currently may include a cellular telephony modem 6, a WiFi module 8, and any of a variety of other components. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The audio player device 100 may include a plurality of communication modules 6, 8. For instance, a first communication package may be dedicated to shorter range wireless communications such as Wi-Fi and Bluetooth and a second communication package may be dedicated to longer range wireless communications such as GPS, EDGE, GPRS, CDMA, WiMAX, LTE, Ev-DO, and others. The wireless communications package may also include components for receiving broadcast signal from terrestrial or satellite transmitters, including AM and FM radio, DAB (Digital Audio Broadcasting) and satellite radio.

In various implementations, the audio player device 100 may be a laptop, a netbook, a notebook, an ultrabook, a smartphone, a wearable device, a tablet, a personal digital assistant (PDA), an ultra mobile PC, a mobile phone, a desktop computer, a server, a printer, a scanner, a monitor, a set-top box, an entertainment control unit, a digital camera, a portable music player, or a digital video recorder. The audio player device may be fixed, portable, or wearable. In further implementations, the audio player device 100 may be any other electronic device that provides analog audio through wires.

As an audio player, the device 100 receives audio, which may be part of other media, such as video or interactive software programs, including games. The audio may be received remotely through any of the communications interfaces 6, 8, or locally from memory 10 or from software instructions executed by the processor 4. The SoC 4 feeds the audio to the audio codec 20 which contains the amplifiers and noise cancellation circuitry described above. The audio codec may also convert the received audio to an analog form suitable for amplification to the speaker 30.

Embodiments may be implemented using one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) of the invention so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to an apparatus with an audio cable to provide an analog audio signal to an audio transducer, the audio cable also receiving a modulated noise current, an output amplifier to receive an audio input, to generate an audio output by amplifying the audio input, and to provide the audio input to the audio cable, and a feedback system to receive the audio output and to receive a reference signal and to generate a noise cancellation signal to the output amplifier, the noise cancellation signal to cancel the modulated noise current.

In further embodiments, the noise cancellation signal is a predictive signal to cancel current noise based on received prior noise. The feedback system has a differential amplifier to combine the audio input with the noise cancellation signal and to provide the differential amplifier output to the output amplifier. The feedback system has a sensing network for the reference signal and a sensing network for the audio output, and wherein the sensing network outputs are combined and compared in a signal processor.

In further embodiments, the feedback system further comprises a sample and hold circuit and an analog to digital converter to receive the sensing network outputs, to digitize the sensing network outputs and to apply the digitized sensing network outputs to the signal processor.

In further embodiments, the signal processor generates an analog signal as the noise cancellation signal to the output amplifier.

Further embodiments include a power amplifier to receive an audio preamp signal and to generate the input signal from the preamp signal and provide the input signal to the output amplifier.

In further embodiments, the preamp signal is the reference signal.

Further embodiments include a passive noise filter between the output amplifier and the audio cable.

Some embodiments pertain to a method that includes receiving an audio input at an audio amplifier, amplifying the audio input at the audio amplifier to generate an amplified audio signal, sending the amplified audio signal from the audio amplifier to an audio transducer through an audio cable, receiving a modulated noise current at the audio amplifier through the audio cable, receiving the amplified audio signal, the modulated noise current, and a reference signal at a feedback system, generating a noise cancellation signal at the feedback system using the amplified audio signal, the modulated noise signal and the reference signal, and sending the noise cancellation signal to the audio amplifier, the noise cancellation signal to cancel the modulated noise current.

In further embodiments, the noise cancellation signal is a predictive signal to cancel current noise based on received prior noise. Generating a noise cancellation signal comprises comparing the amplified audio signal to the reference signal to determine the modulated noise signal.

In further embodiments, comparing comprises comparing in the digital domain and generating comprises generating in the analog domain, the method further comprising converting the amplified audio signal, the modulated noise signal, and the reference signal to the digital domain.

In further embodiments, the signal processor generates an analog signal as the noise cancellation signal to the output amplifier. Generating a noise cancellation signal comprises converting the noise cancellation signal to the analog domain before sending the noise cancellation signal to the audio amplifier. The reference signal comprises an audio preamp signal that is provided to the audio amplifier to generate the amplified audio signal.

Some embodiments pertain to a portable media player that includes a memory to provide audio from the memory, a processor to receive the audio and provide it to an audio codec, an audio cable to provide an analog audio signal to an audio headset, the audio cable also receiving a modulated noise current, an output amplifier of the audio codec to receive an audio input based on the audio received from the processor, to generate an audio output by amplifying the audio input, and to provide the audio input to the audio cable, and a feedback system of the audio codec to receive the audio output and to receive a reference signal and to generate a noise cancellation signal to the output amplifier, the noise cancellation signal to cancel the modulated noise current.

In further embodiments, the feedback system comprises a sensing network for the reference signal and a sensing network for the audio output, and wherein the sensing network outputs are combined and compared in a signal processor.

Further embodiments include a power amplifier of the audio codec to receive an audio preamp signal based on the audio received from the processor and to generate the input signal from the preamp signal and to provide the input signal to the output amplifier, wherein the preamp signal is the reference signal.

The invention claimed is:

1. An apparatus comprising:

an audio cable to provide an analog audio signal to an audio transducer, the audio cable also receiving a modulated noise current;

an output amplifier to receive an audio input, to generate an audio output by amplifying the audio input, and to provide the audio input to the audio cable; and a feedback system to receive the audio output and to receive a reference signal and to generate a noise cancellation signal to the output amplifier, the noise cancellation signal to cancel the modulated noise current.

2. The apparatus of claim 1, wherein the noise cancellation signal is a predictive signal to cancel current noise based on received prior noise.

3. The apparatus of claim 1, wherein the feedback system comprises a differential amplifier to combine the audio input with the noise cancellation signal and to provide the differential amplifier output to the output amplifier.

4. The apparatus of claim 1, wherein the feedback system comprises a sensing network for the reference signal and a sensing network for the audio output, and wherein the sensing network outputs are combined and compared in a signal processor.

5. The apparatus of claim 4, wherein the feedback system further comprises a sample and hold circuit and an analog to digital converter to receive the sensing network outputs, to digitize the sensing network outputs and to apply the digitized sensing network outputs to the signal processor.

6. The apparatus of claim 5, wherein the signal processor generates an analog signal as the noise cancellation signal to the output amplifier.

7. The apparatus of claim 1, further comprising a power amplifier to receive an audio preamp signal and to generate the input signal from the preamp signal and provide the input signal to the output amplifier.

8. The apparatus of claim 7, wherein the preamp signal is the reference signal.

9. The apparatus of claim 1, further comprising a passive noise filter between the output amplifier and the audio cable.

10. A method comprising:

receiving an audio input at an audio amplifier;

amplifying the audio input at the audio amplifier to generate an amplified audio signal;

sending the amplified audio signal from the audio amplifier to an audio transducer through an audio cable;

receiving a modulated noise current at the audio amplifier through the audio cable;

receiving the amplified audio signal, the modulated noise current, and a reference signal at a feedback system;

generating a noise cancellation signal at the feedback system using the amplified audio signal, the modulated noise signal and the reference signal; and sending the noise cancellation signal to the audio amplifier, the noise cancellation signal to cancel the modulated noise current.

11. The method of claim 10, wherein the noise cancellation signal is a predictive signal to cancel current noise based on received prior noise.

12. The method of claim 10, wherein generating a noise cancellation signal comprises comparing the amplified audio signal to the reference signal to determine the modulated noise signal.

13. The method of claim 12, wherein comparing comprises comparing in the digital domain and generating comprises generating in the analog domain, the method further comprising converting the amplified audio signal, the modulated noise signal, and the reference signal to the digital domain.

14. The method of claim 13, wherein the signal processor generates an analog signal as the noise cancellation signal to the output amplifier.

15. The method of claim 10, wherein generating a noise cancellation signal comprises converting the noise cancellation signal to the analog domain before sending the noise cancellation signal to the audio amplifier.

16. The method of claim 10, wherein the reference signal comprises an audio preamp signal that is provided to the audio amplifier to generate the amplified audio signal.

17. A portable media player comprising:

a memory to provide audio from the memory;

a processor to receive the audio and provide it to an audio codec;

an audio cable to provide an analog audio signal to an audio headset, the audio cable also receiving a modulated noise current;

an output amplifier of the audio codec to receive an audio input based on the audio received from the processor, to generate an audio output by amplifying the audio input, and to provide the audio input to the audio cable; and a feedback system of the audio codec to receive the audio output and to receive a reference signal and to generate a noise cancellation signal to the output amplifier, the noise cancellation signal to cancel the modulated noise current.

18. The portable media player of claim 17, wherein the feedback system comprises a sensing network for the reference signal and a sensing network for the audio output, and wherein the sensing network outputs are combined and compared in a signal processor.

19. The portable media player of claim 17, further comprising a power amplifier of the audio codec to receive an audio preamp signal based on the audio received from the processor and to generate the input signal from the preamp signal and to provide the input signal to the output amplifier, wherein the preamp signal is the reference signal.

* * * * *